US006132039A

United States Patent [19]

Nishimura

[11] Patent Number: 6,132,039

[45] Date of Patent: Oct. 17, 2000

[54] INK ACCEPTOR AND RECORDING METHOD USING THE SAME

[75] Inventor: Kazuaki Nishimura, Osaka, Japan

[73] Assignee: General Company Limited, Osaka, Japan

[21] Appl. No.: 09/073,187

[22] Filed: May 6, 1998

[30] Foreign Application Priority Data

May 12, 1997 [JP] Japan ..... 9-121217

[51] Int. Cl.[7] ..... B41J 2/01

[52] U.S. Cl. ..... 347/105

[58] Field of Search ..... 347/105, 101, 347/102

[56] References Cited

U.S. PATENT DOCUMENTS 5,764,262 6/1998 Wu et al. ..... 347/101

FOREIGN PATENT DOCUMENTS 0 164 196 12/1985 European Pat. Off. .
0 199 874 11/1986 European Pat. Off. .
0 379 964 8/1990 European Pat. Off. .
0 634 284 1/1995 European Pat. Off. .
0 767 071 4/1997 European Pat. Off. .
7-17129 1/1995 Japan .
7-149040 6/1995 Japan .
7-257023 10/1999 Japan .
97/01448 1/1997 WIPO .

*Primary Examiner*—Arthur T. Grimley
*Assistant Examiner*—Greg Moldafsky
*Attorney, Agent, or Firm*—Arent Fox Kintner Plotkin Kahn

[57] ABSTRACT

Disclosed is an ink acceptor comprising a sheet-like substrate and an ink accepting layer provided on at least one surface of the substrate, the ink accepting layer containing at least a cationic acrylic resin and an acrylic resin having film-forming properties. Such an ink acceptor is capable of rapidly fixing ink and obtaining a print having excellent water resistance, and is suitably used for printing by an ink-jet printing system.

8 Claims, No Drawings

INK ACCEPTOR AND RECORDING METHOD USING THE SAME

BACKGROUND OF THE INVENTION

1. Field of the Invention

The present invention relates to an ink acceptor such as a printing paper used as a recording medium and a recording method using the same. More particularly, it relates to an ink acceptor used suitably in a recording method by an ink-jet printing system and a recording method using the same.

2. Description of the Prior Art

As a recording medium to be used for printing systems such as heat transfer, PPC, pen plotter, ink-jet printing, etc., various ink acceptors suited to each printing system have hitherto been commercially available. Since printing using an ink-jet printing system has recently been popularized rapidly, an ink acceptor suited for the ink-jet printing system has been studied and developed.

The following characteristics are normally required as necessary conditions to the ink acceptor used in the ink-jet printing:

(a) The absorption capacity of ink is large;
(b) The absorption rate of ink is fast;
(c) The optical density of dots is high and no blur arise on the periphery of dots; and
(d) The shape of dots is nearly round and its outline is not irregular.

To satisfy such requirements, Japanese Patent Laid-Open Publication No. 7-17129 discloses a recording medium wherein an ink accepting layer provided on a substrate contains polyvinyl alcohol, polyalkylene oxide and a hydrophilic acrylic resin.

Japanese Patent Laid-Open Publication No. 7-149040 discloses a recording paper wherein an ink accepting layer contains polyvinyl pyrrolidone and a basic (meth)acrylate copolymer.

Japanese Patent Laid-Open Publication No. 7-257023 discloses an ink-jet printing sheet containing a water-soluble vinyl polymer, a (meth)acrylate polymer and a water-soluble cellulose.

An ink-jet printer has recently been popularized and it has become popular to print a color image by using the ink-jet printing apparatus. A photo-type ink-jet printing apparatus (e.g. PM-700C manufactured by SEIKO EPSON CORP., etc.) has also been popularized. Since color printing is performed by using six color inks in this type, it is necessary that a colorant in ink is rapidly fixed on the surface of an ink acceptor so as to prevent inks of different color from mixing on the surface of the ink acceptor on printing.

With wide popularization of the ink-jet printing apparatus in general offices and homes, high water resistance has been required to a print so that blur of the print does not arise even if tea or water are spilled on an ink acceptor by accident.

However, a conventional ink acceptor as described above had a drawback that a colorant contained in ink can not be fixed in a short time and, furthermore, a print is easily blurred when water is spilled thereon because of insufficient water resistance.

SUMMARY OF THE INVENTION

It is a main object of the present invention to provide an ink acceptor capable of rapidly fixing ink and obtaining a print having excellent water resistance.

It is another object of the present invention to provide an ink acceptor which is suitably used for printing of an ink-jet printing system.

It is another object of the present invention to provide a recording method employing the above-mentioned ink acceptor.

In order to solve the above problems, the ink acceptor of the present invention is characterized by containing a sheet-shape substrate and an ink accepting layer provided on at least one surface of the substrate, the ink accepting layer containing at least a cationic acrylic resin and an acrylic resin having film-forming properties.

An anionic colorant is generally used in ink used for various printings by an ink-jet printing system, etc. Accordingly, since the anionic colorant is combined with a cationic acrylic resin by containing the cationic acrylic resin in the ink accepting layer, the water resistance of ink is improved. Therefore, it is possible to prevent the colorant from easily blurring and spreading on the peripheral portion even if water is spilled thereon.

Since the anionic colorant is easily combined with the cationic acrylic resin, the colorant is fixed to the ink accepting layer almost simultaneously with printing. Therefore, it is possible to prevent the colorant from spreading over the peripheral portion of dots due to absorption of ink in the ink accepting layer. Consequently, a print wherein the optical density of dots is high and no blur arise on the periphery of dots and, besides, the shape of dots is nearly round and its outline is not irregular is obtained.

Since the above cationic acrylic resin is likely to be inferior in durability of a film and adhesion when used alone, an acrylic resin having film-forming properties is contained in the ink accepting layer together with the cationic acrylic resin. In this case, the cationic acrylic resin and acrylic resin having film-forming properties are the same acrylic resins thereby being superior in compatibility and, therefore, an uniform ink accepting layer can be easily formed.

Examples of the acrylic resin having film-forming properties include self-crosslinking acrylic resins.

As described above, the ink acceptor of the present invention is particularly used in relation to ink containing the anionic colorant. Accordingly, the recording method of the present invention is characterized by recording on the surface of the ink accepting layer of the ink acceptor described above using ink containing the anionic colorant.

The ink acceptor of the present invention can be used, particularly preferably, in the recording method using an ink-jet printing system of discharging ink containing an anionic colorant through an orifice of an ink-jet printing head to record on the surface of the ink accepting layer.

DETAILED DESCRIPTION OF THE INVENTION

The ink accepting layer in the present invention contains a cationic acrylic resin and an acrylic resin having film-forming properties.

Examples of the cationic acrylic resin include acrylic homopolymer or copolymer using a monomer having a cationic group. Examples of the monomer having a cationic group include dimethylaminoethyl acrylate, dimethylaminoethyl methacrylate, diethylaminoethyl acrylate, diethylaminoethyl methacrylate, methylethylaminomethylacrylate, methylethylaminoethylmethacrylate, diethylaminostyrene, methylethylaminostyrene, a quaternary ammonium salt thereof, and the like.

A monomer having no cationic group can be appropriately selected, for example, from $C_1$–$C_6$ alkyl acrylate, $C_1$–$C_6$ alkyl methacrylate and styrene. A monomer having a hydroxyl group may be used in order to enhance absorption of the ink accepting layer.

As the other monomer having a cationic group, there can also be used a monomer having a primary to tertiary amino group or a quaternary ammonium salt group at the side chain, which is copolymerizable with a normal acrylic or methacrylic monomer.

As the acrylic resin having film-forming properties used in the present invention, those which enhance the film stability and water resistance of the ink accepting layer are preferable, and examples thereof include polyacrylamide, polymethyl methacrylate, polybutyl methacrylate, polymethyl acrylate, polybutyl acrylate, polystyrene-2-acrylonitrile, acrylonitrile-vinyl acetate copolymer, acrylonitrile-vinyl chloride copolymer, acrylonitrile-styrene copolymer, acrylonitrile-vinylidene chloride copolymer, acrylonitrile-vinylpiridine copolymer, acrylonitrile-methyl methacrylate copolymer, acrylonitrile-butyl acrylate copolymer and the like. As the other acrylic resin having film-forming properties, a thermosetting acrylic resin obtained by reacting a monomer or oligomer of an acrylate or methacrylate with a thermosetting resin such as epoxy resin, phenol resin, etc. can also be preferably used.

In the present invention, to secure the film stability and flexibility of the ink accepting layer, a self-crosslinking acrylic resin can be used, particularly preferably, as the acrylic resin having film-forming properties. The self-crosslinking acrylic resin has a self-crosslinking reactive group in the polymer or at the terminal thereof, and examples thereof include Yodosol A-4100 manufactured by NIPPON NSC Co., Ltd.

A proportion of the cationic acrylic resin to the acrylic resin having film-forming properties, which respectively constitute the ion accepting layer, may be from 7:3 to 2:8, preferably from 5:5 to 3:7, in a weight ratio.

Examples of the other component, which may be contained in the ink accepting layer, include filler. As such a filler, there can be used inorganic fillers such as silica, alumina, aluminum silicate, magnesium silicate, basic magnesium carbonate, talc, clay, hydrosulfite, calcium carbonate, titanium oxide, zinc oxide, etc.; and organic fillers such as polyethylene, polystyrene, polyacrylate, etc.

Such a filler can be added in the proportion of 50 to 80% by weight, preferably 60 to 75% by weight, based on the total amount of the ink accepting layer.

There may be further added various surfactants, colorant fixing agents (agents for improving water resistance), defoamers, antioxidants, fluorescent whiteners, ultraviolet absorbers, dispersants, viscosity adjustors, pH adjustors, plasticizers, etc., if necessary.

Examples of the substrate in the present invention include papers such as woodfree paper, moderate paper, art paper, bond paper, regenerated paper, baryta paper, cast coated paper, corrugated fiberboard paper, condenser paper, glassine paper, etc.; synthetic resin films such as polysulfon film, polystyrene film, polyamide film, polyimide film, polycarbonate film, polypropylene film, cellophane, polyester film (e.g. polyethylene telephthalate film, etc.), polyethylene naphthalate film, triacetate film, etc.; plastic boards which are made of systhetic resins such as the ones composed in the above-mentioned systhetic resin films; glass plates; and clothes of various fibers such as cotton, rayon, acrylic fiber, nylon, silk, polyester fiber, etc.

The ink acceptor of the present invention can be produced by applying a coating solution containing a cationic acrylic resin and an acrylic resin having film-forming properties on a substrate followed by drying.

To prepare the coating solution, for example, each predetermined amount of the above cationic acrylic resin and acrylic resin having film-forming properties are added to a solvent, together with other additives such as filler, etc., followed by stirring so that the mixture becomes uniform. As the solvent, for example, water, lower alcohols such as methanol, ethanol, butanol, etc. can be used. It is particularly preferable to use water alone or a mixed solvent of water and a lower alcohol in view of ease of handling.

To apply the coating solution on the substrate, all of various devices such as blade coater, roll coater, air-knife coater, bar coater, rod coater, gate roll coater, curtain coater, short dwell coater, gravure coater, flexogravure coater, size press, etc. can be used.

With respect to the drying, force-drying may be performed by using a hot-air dryer, heat drum, etc. or air-drying may be performed.

A calendering treatment or a super calendering treatment may be optionally performed by using a machine calender, a TG calender, a super calender, a soft calender, etc. to enhance the smoothness or surface strength of the surface of the resulting ink acceptor after drying.

The coating amount of the coating solution for forming the ink accepting layer to be coated onto the substrate is not less than 0.1 $g/m^2$, preferably 0.1 to 70 $g/m^2$, more preferably 3 to 25 $g/m^2$, calculated based on the solid content. When the coating amount is smaller than the above range, an ink acceptor having excellent fixing property and water resistance can not be obtained. On the other hand, when the coating amount exceeds the above range, curling is liable to arise drastically in the ink acceptor and the ease of handling becomes inferior. The thickness of the ink accepting layer after drying is from 5 to 50 $\mu$m, preferably from 10 to 25 $\mu$m.

The recording method using the ink acceptor of the present invention will be described hereinafter. This recording method is characterized by recording on the surface of the ink accepting layer of the ink acceptor of the present invention, using ink containing an anionic colorant.

Such a recording method can be applied to various printing means such as heat transfer, PPC, pen plotter, ink-jet printing, etc.

Particularly, the ink acceptor of the present invention is optimum for using in the recording method of an ink-jet printing system, which is required to satisfy the above necessary conditions (a) to (d). That is, according to this recording method, recording is performed by discharging ink containing an anionic colorant through an orifice of an ink-jet printing head on the surface of the ink accepting layer of the above ink acceptor.

Ink, which can be used in the recording method of the present invention, can be obtained by mixing the anionic colorant with water or with water and a water-soluble organic solvent.

Examples of the anionic colorant include black dyes such as nigrosine, C.I. Solvent Black 3, C.I. Solvent Black 5, C.I. Solvent Black 7, C.I. Solvent Black 22, C.I. Solvent Black 23, etc.; yellow dyes such as C.I. Solvent Yellow 2, C.I. Solvent Yellow 6, C.I. Solvent Yellow 14, C.I. Solvent Yellow 15, C.I. Solvent Yellow 19, C.I. Solvent Yellow 21, C.I. Solvent Yellow 80, etc.; magenta dyes such as C.I. Solvent Red 3, C.I. Solvent Red 8, C.I. Solvent Red 24, C.I. Solvent Red 25, C.I. Solvent Red 49, C.I. Solvent Red 81, C.I. Solvent Red 82, C.I. Solvent Red 83, C.I. Solvent Red 84, C.I. Solvent Red 109, C.I. Solvent Red 121, etc.; and cyane dyes such as C.I. Solvent Blue 11, C.I. Solvent Blue 12, C.I. Solvent Blue 25, C.I. Solvent Blue 36, C.I. Solvent Blue 55, C.I. Solvent Blue 73, etc.

The amount of the colorant added is from 1 to 30% by weight, preferably from 3 to 12% by weight, based on the total amount of ink.

As the solvent for dissolving the colorant, for example, water (preferably, ultra-purified water) is used. Water may be used alone or in combination with a water-soluble organic solvent. Examples of the water-soluble organic solvent include alkyl alcohols having 1 to 5 carbon atoms, such as methyl alcohol, ethyl alcohol, n-propyl alcohol, isopropyl alcohol, n-butyl alcohol, sec-butyl alcohol, tertbutyl alcohol, isobutyl alcohol, n-pentanol, etc.; amides such as dimethylformamide, dimethylacetamide, etc.; ketones or ketone alcohols such as acetone, diacetone alcohol, etc.; ethers such as dioxan, etc; polyalkylene glycols, such as polyethylene glycol, polypropylene glycol, etc.; alkylene glycols containing an alkylene group having 2 to 6 carbon atoms, such as ethylene glycol, propylene glycol, butylene glycol, triethylene glycol, 1,2,6-hexanetriol, thiodiglycol, hexylene glycol, diethylene glycol, etc.; glycerin; lower alkyl ethers of polyhydric alcohol, such as ethylene glycol monomethyl ether, ethylene glycol monoethyl ether, diethylene glycol monomethyl ether, diethylene glycol monoethyl ether, triethylene glycol monomethyl ether, triethylene glycol monoethyl ether, etc.; lower dialkyl ethers of polyhydric alcohol, such as triethylene glycol dimethyl ether, triethylene glycol diethyl ether, tetraethylene glycol dimethyl ether, tetraethylene glycol diethyl ether, etc.; and sulfolane, N-methyl-2-pyrrolidone, 1,3-dimethyl-2-imidazolidinone, etc.

The amount of the above water-soluble organic solvent contained in ink is generally from 0 to 80% by weight, preferably from 2 to 80% by weight, more preferably from 3 to 70% by weight, particularly 4 to 60% by weight, based on the total amount of ink. The amount of water used as a suitable liquid medium contained in ink of the present invention is generally not less than 10% by weight, preferably from 10 to 97.5% by weight, more preferably from 35 to 97.5% by weight, particularly 45 to 97.5% by weight, based on the total amount of ink. When the amount of the water-soluble organic solvent in ink exceeds 80% by weight or the amount of water in ink is less than 10% by weight, a large amount of a low-volatile organic solvent is remained in the formed recording image and there is a fear of causing a problem such as blur of the image, etc.

In addition to the above components, if necessary, pH adjustors, viscosity adjustors, surface tension adjustors, binders, humectants, antifungal substances, etc. can be appropriately added to ink used in the present invention. Examples of the pH adjustor include organic amines such as diethanolamine, triethanolamine, etc.; and inorganic alkaline agents containing hydroxides of alkaline metals, such as sodium hydroxide, lithium hydroxide, potassium hydroxide, etc.

The pH of ink is from 6.0 to 10.0, preferably from 7 to 9 so that corrosion of a heating head or other metal parts is prevented and, at the same time, the stability of the colorant and other additives is enhanced and precipitation thereof is prevented.

The viscosity of ink is from 1 to 20 mP·s, preferably from 1 to 15 mP·s, more preferably from 1 to 5 mP·s, in viscosity measured at 25° C. by using a R type viscometer. The surface tension of ink is not less than 20 dyn/cm, preferably from 20 to 65 dyn/cm, more preferably from 30 to 65 dyn/cm. The density of ink is preferably about 1 g/cm$^3$.

The recording method of the present invention can be preferably applied to an on-demand type ink-jet printing system of discharging ink through a nozzle only on print recording. Although the on-demand type ink-jet printing system can be classified roughly into a so-called piezo system using a piezo element (piezo element system) and a so-called thermal-jet system (bubble-jet system), the recording method of the present invention can be applied to both of them.

In the thermal-jet system, a nozzle is filled with ink and the surface of a thermal head is momentarily heated to form bubbles in the nozzle. Then, liquid droplets of ink are discharged through the nozzle by the pressure of bubbles to record on a recording paper.

As described above, according to the present invention, since the ink accepting layer contains at least a cationic acrylic resin and an acrylic resin having film-forming properties, the water resistance of ink is improved and there is also exerted such an effect that the fixing rate of ink is high and the optical density of the print is also high.

EXAMPLES

The following Example and Comparative Example further illustrate the present invention in detail.

Example 1

A coating solution of the following composition was applied on one surface of a woodfree paper of 135 g/m$^2$ using a bar coater so that the thickness after drying is from 8 to 20 $\mu$m (coating amount: 5–20 g/m$^2$). After air-drying, an ink acceptor having an ink accepting layer on one surface was obtained.

| (Composition) | (Parts by weight) |
|---|---|
| Self-crosslinking type acrylic copolymer resin emulsion (Yodosol A-4100, manufactured by NIPPON NSC Co., Ltd., solid content: 60%) | 6.7 |
| Cationic acrylate copolymer resin emulsion (Rika-bond GL-F9675, manufactured by Chuo Rika Kogyo Corp., solid content: 40%) | 7.5 |
| Synthetic silica (Sylysia 350, manufactured by Fuji Silysia Chemical Ltd.) | 7 |
| Purified water | 52.8 |
| Methanol | 26 |

A proportion of the cationic acrylic resin to the (self-crosslinking) acrylic resin having film forming properties, which respectively constitute the ink accepting layer was about 5.7:4.3 in a weight ratio, and an amount of the synthetic silica contained in the ink accepting layer was 50% by weight based on the total amount of the ink accepting layer.

Comparative Example 1

According to the same manner as that described in Example 1 except for using those having the following composition as the coating solution, an ink acceptor was obtained.

| (Composition) | (Parts by weight) |
|---|---|
| Polyvinyl alcohol (SMR-10H, manufactured by Shin-Etsu Chemical Co., Ltd.) | 4 |
| Cationic acrylate copolymer resin emulsion (Rika-bond GL-F9675, manufactured by Chuo Rika Kogyo Corp., solid content: 40%) | 7.5 |
| Synthetic silica (Sylysia 350, manufactured by Fuji Silysia Co., Ltd.) | 7 |
| Purified water | 55.5 |
| Methanol | 26 |

Printing

Using an ink-jet printer of a thermal-jet system (BJC420J, manufactured by Canon INC.), printing was performed on the surface of each ink acceptor obtained in the Example and Comparative Example. Ink used is that prepared by dissolving an anionic dye (Special Black 7984, manufactured by Bayer Co.) as a colorant in ultra-purified water and adjusting the concentration of the dye to 3% by weight.

Evaluation Test

The prints recorded on the respective ink acceptors of the Example and Comparative Example were evaluated with respect to the following items.

(1) Fixing Property

After the lapse of 10 seconds since the completion of the printing, a print was scrubbed with woodfree papers and then it was visually confirmed whether ink is adhered on woodfree papers. The evaluation was performed by the following criteria.

E: no ink adhesion was found on the woodfree paper and the fixing property was excellent.

G: slight ink adhesion was found on a woodfree paper; however, the fixing property was good.

B: large amount of ink adhesion was found on the woodfree paper and the fixing property was bad.

(2) Printing Quality

The print was visually observed. The evaluation was performed by the following criteria.

E: the print was clear and the printing quality was excellent.

G: slightly unclear parts were found in the print; however the printing quality was good.

B: the print was unclear and the printing quality was bad.

(3) Water Resistance

The ink acceptor, after the lapse of 10 seconds since the completion of the printing, was dipped into water and it was confirmed whether the print disappears or not. The evaluation was performed by the following criteria.

E: the ink did not disappear and the water resistance was excellent.

G: the ink slightly disappeared and slight blur was found in the print; however, the water resistance was good.

B: the ink disappeared so that the print was illegible and the water resistance was bad.

(4) Rub Resistance

The printed surface of the ink acceptor, after the lapse of 10 seconds since the completion of the printing, was rubbed 20 times with a cotton swab impregnated with water and the condition of the surface was visually observed. The evaluation was performed by the following criteria.

E: no ink dispersion was found and the rub resistance was excellent.

G: slight ink dispersion and slight blur in the print were found; however, the rub resistance was good.

B: the print was illegible because of the ink dispersion and the rub resistance was bad.

These test results are shown in Table 1.

TABLE 1

| | Example | Comp. Example |
|---|---|---|
| (1) Fixing property | E | B |
| (2) Printing quality | E | E |

TABLE 1-continued

| | Example | Comp. Example |
|---|---|---|
| (3) Water resistance | E | B |
| (4) Rub resistance | E | B |

As is apparent from Table 1, the ink acceptor of the Example is capable of rapidly fixing and obtaining a print having excellent printing quality, water resistance and rub resistance.

Examples 2–7

According to the same manner as that described in Example 1 except for blending three compositions out of the compositions of the coating solution, namely self-crosslinking acrylic polymer resin emulsion, cationic acrylic ester polymer resin emulsion and synthetic silica, in the amounts (parts by weight) as shown in Tables 2 and 3; and then blending pure water and methanol with a part (14 parts by weight in total solid amount) of the above-mentioned three compositions in the amounts (parts by weight) as shown in Tables 2 and 3, an ink acceptor having an ink accepting layer on one surface was obtained.

Proportions (in a weight ratio) of the cationic acrylic resin to the (self-crosslinking) acrylic resin having film forming properties which respectively constitute the ink accepting layer and amounts of the synthetic silica contained in the ink accepting layer based on the total amount of the ink accepting layer were as shown in Tables 2 and 3.

The prints recorded on the respective ink acceptors of the above Examples were evaluated in the same manner as described above to evaluate the characteristics. The results are shown in Tables 2 and 3.

TABLE 2

| | Ex. 2 | Ex. 3 | Ex. 4 |
|---|---|---|---|
| parts by weight | | | |
| self-crosslinking acrylic emulsion | 3.3 | 4.2 | 5.0 |
| cationic acrylic emulsion | 20.0 | 18.8 | 17.5 |
| synthetic silica | 10.0 | 10.0 | 10.0 |
| parts by weight | | | |
| pure water | 50.7 | 50.9 | 51.3 |
| methanol | 26.0 | 26.0 | 26.0 |
| cationic acrylic resin: self-crosslinking acrylic resin | 8:2 | 7.5:2.5 | 7:3 |
| synthetic silica (% parts) | 50 | 50 | 50 |
| (1) fixing property | G | G | E |
| (2) printing quality | G | G | E |
| (3) water resistance | G | G | E |
| (4) rub resistance | G | E | E |

TABLE 3

| | Ex. 5 | Ex. 6 | Ex. 7 |
|---|---|---|---|
| parts by weight | | | |
| self-crosslinking acrylic emulsion | 6.7 | 13.4 | 14.2 |
| cationic acrylic emulsion | 15.0 | 5.0 | 3.8 |
| synthetic silica | 10.0 | 10.0 | 10.0 |

TABLE 3-continued

| | Ex. 5 | Ex. 6 | Ex. 7 |
|---|---|---|---|
| parts by weight | | | |
| pure water | 51.8 | 54.1 | 54.4 |
| methanol | 26.0 | 26.0 | 26.0 |
| cationic acrylic resin: self-crosslinking acrylic resin | 6:4 | 2:8 | 1.5:8.4 |
| synthetic silica | 50 | 50 | 50 |
| (% parts) | | | |
| (1) fixing property | E | E | G |
| (2) printing quality | E | E | G |
| (3) water resistance | E | E | G |
| (4) rub resistance | E | E | G |

As is apparent from the Tables 2 and 3, the proportion of the cationic acrylic resin to the (self-crosslinking) acrylic resin is preferably from 7:3 to 2:8 in a weight ratio.

Examples 8–15

According to the same manner as that described in Example 1 except for blending three compositions out of the compositions of the coating solution, self-crosslinking acrylic polymer resin emulsion, cationic acrylic ester polymer resin emulsion and synthetic silica, in the amounts (parts by weight) as shown in Tables 4 and 5; and then blending pure water and methanol to a part (14 parts by weight in total solid amount) of the above-mentioned three compositions in the amounts (parts by weight) as shown in Tables 4 and 5, an ink acceptor having an ink accepting layer on one surface was obtained.

Proportions (in a weight ratio) of the cationic acrylic resin to the (self-crosslinking) acrylic resin having film forming properties which respectively constitute the ink accepting layer and amounts of the synthetic silica contained in the ink accepting layer based on the total amount of the ink accepting layer were as shown in Tables 4 and 5.

The prints recorded on the respective ink acceptors of the above Examples were evaluated in the same manner as described above to evaluate the characteristics. The results are shown in Tables 4 and 5.

TABLE 4

| | Ex. 8 | Ex. 9 | Ex. 10 | Ex. 11 |
|---|---|---|---|---|
| parts by weight | | | | |
| self-crosslinking acrylic emulsion | 10.0 | 10.0 | 10.0 | 10.0 |
| cationic acrylic emulsion | 10.0 | 10.0 | 10.0 | 10.0 |
| synthetic silica | 8.2 | 10.0 | 12.2 | 15.0 |
| parts by weight | | | | |
| pure water | 66.3 | 67.0 | 67.7 | 68.4 |
| methanol | 26.0 | 26.0 | 26.0 | 26.0 |
| cationic acrylic resin: self-crosslinking acrylic resin | 4:6 | 4:6 | 4:6 | 4:6 |
| synthetic silica | 45 | 50 | 55 | 60 |
| (% parts) | | | | |
| (1) fixing property | E | E | E | E |
| (2) printing quality | B | G | E | E |
| (3) water resistance | G | G | G | E |
| (4) rub resistance | E | E | E | E |

TABLE 5

| | Ex. 12 | Ex. 13 | Ex. 14 | Ex. 15 |
|---|---|---|---|---|
| parts by weight | | | | |
| self-crosslinking acrylic emulsion | 10.0 | 10.0 | 10.0 | 10.0 |
| cationic acrylic emulsion | 10.0 | 10.0 | 10.0 | 10.0 |
| synthetic silica | 18.6 | 30.0 | 40.0 | 45.6 |
| parts by weight | | | | |
| pure water | 69.1 | 70.5 | 71.2 | 71.5 |
| methanol | 26.0 | 26.0 | 26.0 | 26.0 |
| cationic acrylic resin: self-crosslinking acrylic resin | 4:6 | 4:6 | 4:6 | 4:6 |
| synthetic silica | 65 | 75 | 80 | 82 |
| (% parts) | | | | |
| (1) fixing property | E | E | E | G |
| (2) printing quality | E | E | E | E |
| (3) water resistance | E | E | G | G |
| (4) rub resistance | E | E | G | B |

As is apparent from the Tables 4 and 5, the amount of the synthetic silica contained in the ink accepting layer as a filler is preferably from 50% to 80% by weight, more preferably from 60% to 75% by weight, based on the total amount of the ink accepting layer.

Although the present invention has been described in detail by way of the examples thereof, it should be understood that the foregoing disclosure is merely illustrative of the technical principles of the present invention but not limitative of the same. The spirit and scope of the present invention are to be limited only by the appended claims.

What is claimed is:

1. A method for recording ink on a sheet-shaped substrate, the method comprising:

providing an ink accepting layer on at least one surface of a sheet-shaped substrate, the ink accepting layer comprising a cationic acrylic resin and an acrylic resin having film-forming properties;

thereafter, drying the ink accepting layer; and thereafter, contacting ink containing an anionic colorant with the ink accepting layer, wherein the colorant is fixed to the ink accepting layer as it contacts the ink accepting layer.

2. The method of claim 1, wherein said contacting step comprises discharging the ink through an orifice of an ink-jet printing head.

3. The method of claim 1, wherein the acrylic resin having film-forming properties is a self-crosslinking acrylic resin.

4. The method of claim 1, wherein the ink accepting layer contains the cationic acrylic resin and the acrylic resin having film-forming properties in a weight ratio within a range of from 7:3 to 2:8.

5. The method of claim 1, wherein a thickness of the ink accepting layer is within a range of from 5 to 50 $\mu$m.

6. The method of claim 1, wherein the ink accepting layer contains a filler.

7. The method of claim 6, wherein the filler is a silica.

8. The method of claim 7, wherein the ink accepting layer contains the filler in an amount within a range of from 50 to 80% by weight based on a total weight of the ink accepting layer.

* * * * *